United States Patent [19]

Nishimura

[11] Patent Number: 5,000,127

[45] Date of Patent: Mar. 19, 1991

[54] CYLINDER SLEEVE FOR TWO-CYCLE ENGINE

[75] Inventor: Seiichi Nishimura, Hamamatsu, Japan

[73] Assignee: Sanshin Kogyo Kabushiki Kaisha, Hamamatsu, Japan

[21] Appl. No.: 548,020

[22] Filed: Jul. 5, 1990

[30] Foreign Application Priority Data

Jul. 17, 1989 [JP] Japan ..... 1-182534

[51] Int. Cl.[5] ..... F02F 1/10

[52] U.S. Cl. ..... 123/41.84; 123/193 C; 123/668; 29/888.061

[58] Field of Search ..... 123/41.84, 65 R, 193 C, 123/193 CP, 668, 669; 29/888.061

[56] References Cited

U.S. PATENT DOCUMENTS 4,630,345 12/1986 Lutz ..... 123/193 C

FOREIGN PATENT DOCUMENTS 47-26938 7/1972 Japan ..... 123/193 C 496250 11/1938 United Kingdom ..... 123/193.C

*Primary Examiner*—Noah P. Kamen

*Attorney, Agent, or Firm*—Ernest A. Beutler

[57] ABSTRACT

A cylinder liner and method for forming it for a reciprocating machine including a sleeve having one or more port openings that have stepped diameters so as to form a shoulder. The shoulder lies approximately at the finished outer diameter of the sleeve and a resist or stop layer is positioned on the larger diameter portion of the port opening and the sleeve is plated so that the plating layer will extend only over the inner surface, first portion of the port opening and the shoulder. As a result, removal of the outer sleeve periphery will not upset the plating layer nor will it leave edges of the plating layer exposed to flow through the port as might cause erosion.

6 Claims, 3 Drawing Sheets

CYLINDER SLEEVE FOR TWO-CYCLE ENGINE

BACKGROUND OF THE INVENTION

This invention relates to a cylinder sleeve for a reciprocating machine such as a two-cycle engine and more particularly to an improved cylinder sleeve and method manufacturing it for such machines.

In many forms of reciprocating machines, such as internal combustion engines, a cylinder liner is employed that is pressed or otherwise secured within a cylinder block. Such constructions are frequently employed so as to permit the use of lightweight cylinder block materials with a more rigid wear resistant material being utilized to form the actual cylinder liner. Frequently it is also the practice to form the cylinder liner with a plating wear resistant coating on its inner surface so as to further improve the longevity and performance of the machine.

In connection with such machines, particularly those operating on a two-stroke principal, it has been the practice to form one or more ports that extend through the cylinder liner and which cooperate with matching ports in the cylinder block material. Where the cylinder liner is plated and has ports, this can present certain problems as may be best understood by reference to FIG. 1 which is a showing of a cylinder liner, indicated generally by the reference numeral 12 in which a scavenge port 13 and exhaust port 14 are formed. The cylinder liner 12 is comprised of a base material 15 such as an aluminum alloy on which a wear resistant coating 16 is plated. The coating may be silicone or a silicone alloy or the like.

As may be readily seen from FIG. 1, the plating process tends to cause an extending portion of the plating material 16 to extend through and beyond the periphery of the scavenge and exhaust ports 13 and 14. This extending material is indicated by the reference numerals **16*a* and 16*b*. Hence, when the cylinder liner 12 has its outer peripheral surface machined, as by turning using a cutting tool 17, the leading portion of the plating 16*a* and 16*b* will be tend to be torn away from the base material 15. This will occur even if the plating material does not extend beyond the outer periphery of the respective ports 13 and 14**.

One way in which it has been proposed to eliminate the aforenoted problem, is by using a jig or fixture 18 as seen in FIG. 2, which is put in place during the plating process so that the plating 16 will not extend to the finish diameter D of the finished material. Of course, this necessitates the use of special jigs during the plating process and can increase the cost. In addition, it may not be possible to fully insure that the plating will be stopped beyond the portion of the port internally of the finished diameter D. Another method is to employ a protective or stop coating 19 during the plating process which then must be removed subsequently as shown in FIG. 3.

Even if the two methods previously described are employed and are successful, certain problems still exist when the cylinder liner 12 is positioned in the cylinder block as may be best understood by reference to FIG. 4. In this figure, the cylinder block is indicated by the reference numeral 21 and it will be noted that is has a scavenge port 22 that cooperates with the corresponding port 13 formed in the liner 12 and an exhaust port 23 that cooperates with the liner exhaust port 14. It will be seen that the resulting construction leaves shoulders that are exposed to and can interfere with the gas flows through these ports. In addition, these shoulders themselves offer surfaces against which the flow can impact and cause erosion or stripping of the plating material 16.

It is, therefore, a principal object of this invention to provide an improved plated cylinder liner for a reciprocating machine and method of manufacturing it that will not have the disadvantages as aforenoted.

Specifically, it is an object of this invention to provide a method for making a plated liner and such a liner wherein the plating will not tend to abrade, wear off or interfere with the flow in ultimate use.

It is a still further object of this invention to provide an improved method for manufacturing a plated port for a cylinder liner and a port configuration therefore.

SUMMARY OF THE INVENTION

This invention is adapted to be embodied in a cylinder liner for a reciprocating machine having a sleeve formed of a first material and having an inner cylindrical surface that is adapted to receive a piston. A port opening extends through the sleeve and has a first portion extending outwardly from the inner surface and a second portion of larger cross-sectional area forming a should at the junction of the portions and extending to the outer periphery of the sleeve. A plating layer extends along the inner surface and only the first portion of the port opening.

Another feature of the invention is adapted to be embodied in a method for making a cylinder liner for a reciprocating machine that is comprised of a sleeve having formed from a first material and having an inner cylindrical surface adapted to receive a piston. In accordance with this feature of the invention, a port opening is formed that extends through the sleeve and which has a first portion extending radially outwardly from the inner surface and a second portion of larger cross section forming a shoulder at the juncture of the portions and which extends outwardly to the outer periphery of the sleeve. A stop or plating resist material is applied to the second portion of the port openings and the inner cylindrical surface and the first portion of the port opening are plated.

DETAILED DESCRIPTION OF THE PREFERRED EMBODIMENT OF THE INVENTION

Figure 1:
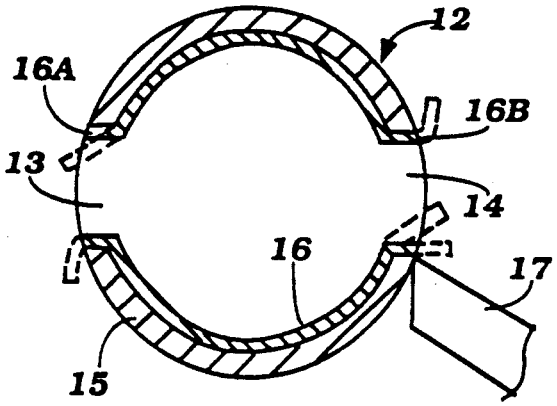
Figure 1 Prior Art
FIG. 1 is a transverse cross-sectional view taken through a cylinder liner constructed in accordance with a prior art method and showing the machining of the outer surface.
Figure 2:
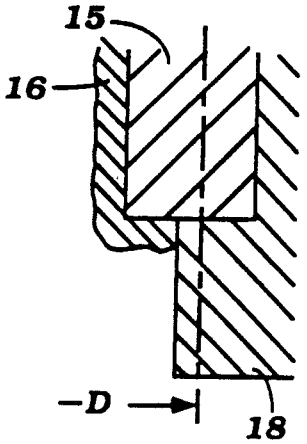
Figure 2 Prior Art
FIG. 2 is a an enlarged cross-sectional view of one prior art method for precluding the formation of the plating layer adjacent the outer surface of the liner.
Figure 3:
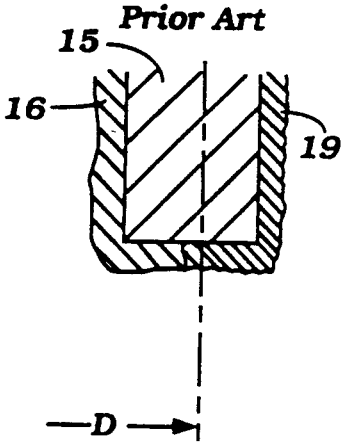
Figure 3 Prior Art
FIG. 3 is a cross-sectional view, in-part-similar to FIG. 2, and shows another prior art method for avoiding the plating layers extending to the outer surface of the liner.

Referring now in detail to FIGS. 5 through 11 and initially primarily to FIGS. 5 through 10, a cylinder liner constructed in accordance with the invention is first formed with a sleeve portion, indicated generally by the reference numeral 51 which may be formed from a known material such as aluminum or on aluminum alloy or the like and which has a cylindrical bore 52 which, when plated, is intended to receive a piston. The sleeve 51 has an outer diameter 53 in its as formed condition which has a diameter D' that is greater than the finished diameter of the liner.

Port openings, comprised of one or more scavenge ports indicated generally by the reference numeral 54 and one or more exhaust ports, indicated generally by the reference numeral 55 are then formed extending through the wall of the sleeve 51. Each port has a respective first portion 54A or 55A that extends from the cylindrical portion 52 in a generally outward direction. The extent of the port portions 54A and 55A is slightly less than the finished wall thickness of the liner, for a reason to be described.

Each port 54 and 55 further includes an outer, larger diameter portion 54B and 55B which, due to its larger diameter, results in the formation of a respective shoulder 54C or 55C where the portions 54A, 55A, and 54B and 55B join.

Figure 5:
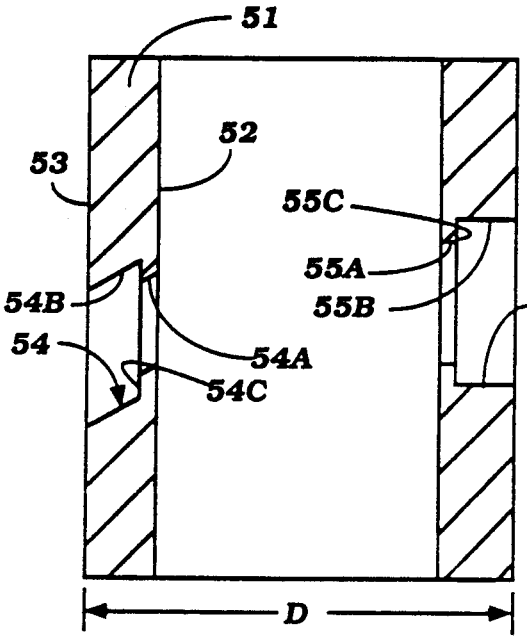
FIGS. 5 through 8 are axial cross-sectional views taken through a cylinder liner formed in accordance with the method of the invention and resulting in a liner embodying the invention.
Figure 6:
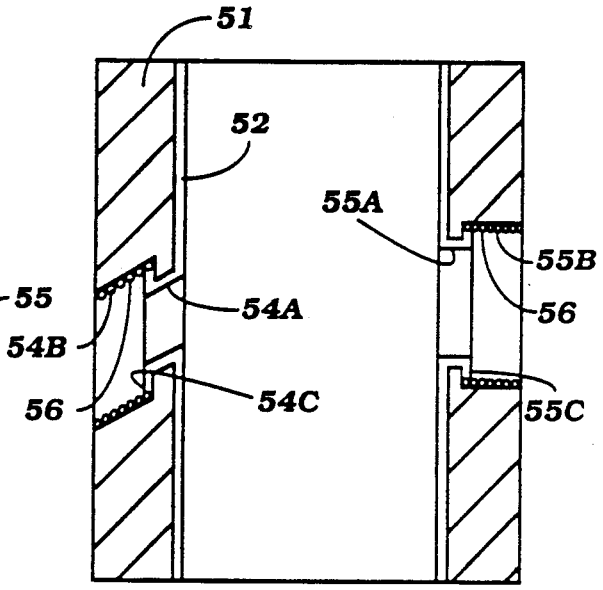

After the ports 54 and 55 are formed as shown in FIG. 5, a resist or stopper layer 56 is applied to the port portions 54B and 55B up to the respective shoulders 54C and 55C as shown in FIG. 6. The layer 56 is a layer that will resist and preclude the formation of plating of the plating layer onto the sleeve 51.

Figure 7:
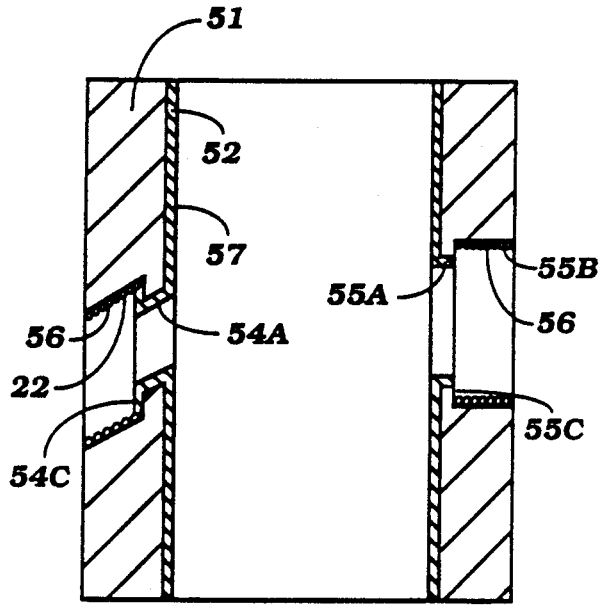
Figure 8:
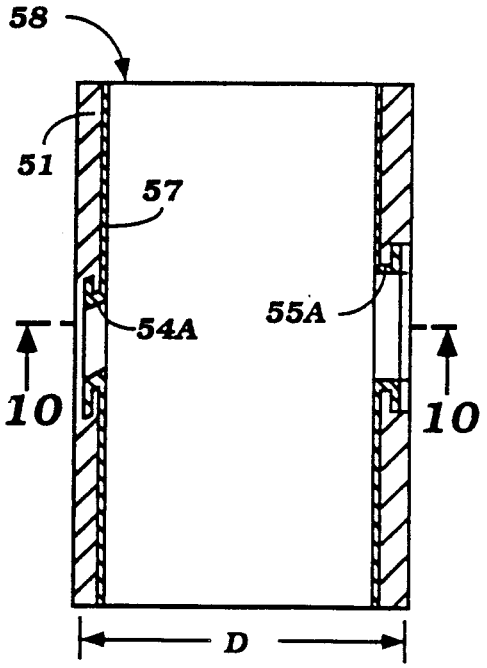
Figure 9:
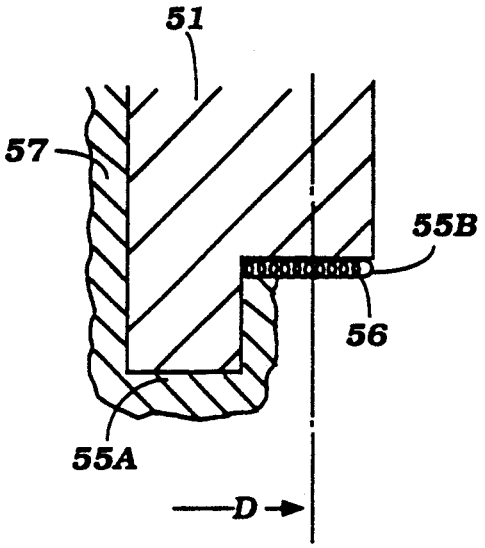
FIG. 9 is a further enlarged cross-sectional view showing the resist or stop layer and how it effects the plating.
Figure 10:
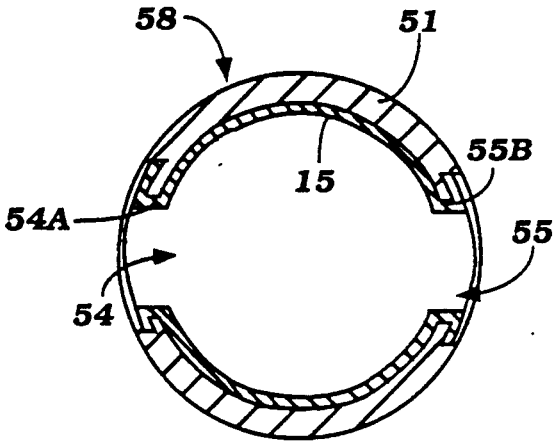
FIG. 10 is a cross-sectional view taken along the line 10—10 of FIG. 8.
Figure 11:
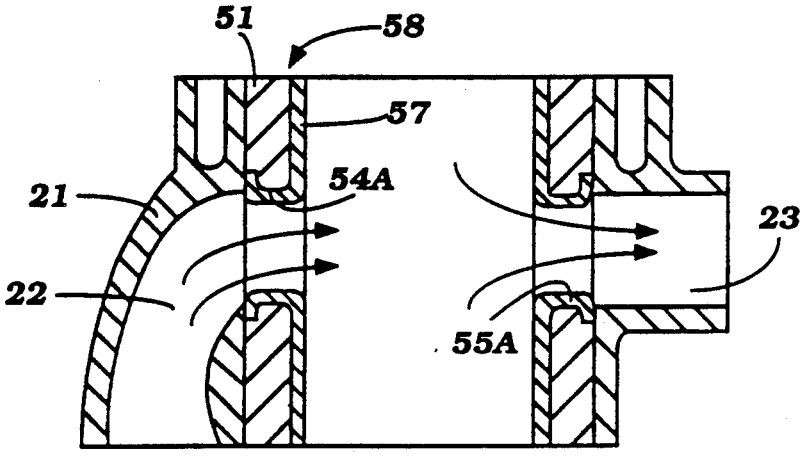
FIG. 11 is an axial cross-sectional view showing the liner in place in a reciprocating machine.

Next, as may be seen in FIG. 7, a plating layer 57 is deposited on the cylindrical inner surface 52, the port portions 54A and 55A and the shoulders 54C and 55C. Because of the stop or resist layers 56, the plating will not be applied to the port portions 54B and 55B. It should be noted that the plating 57 then actually forms a mechanical interlock with the port portions 54A and 55A.

Figure 4:
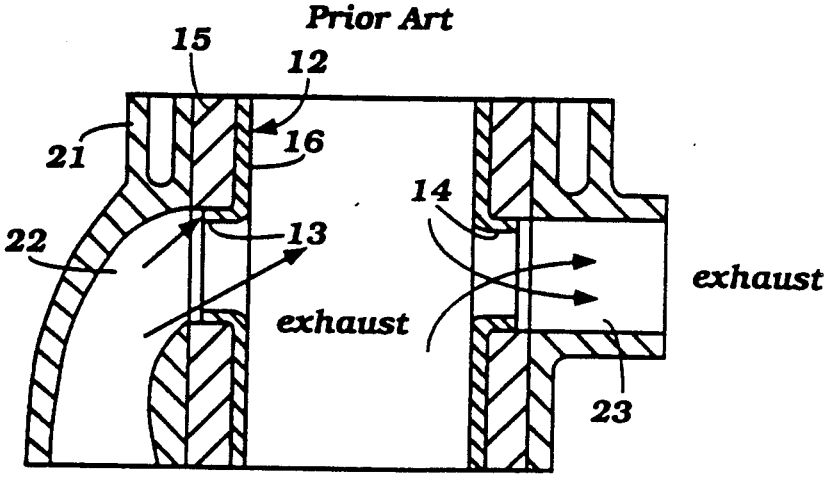
Figure 4 Prior Art
FIG. 4 is a cross-sectional view taken along the axis of the cylinder bore of one cylinder of a reciprocating machine constructed in accordance with the prior art.

Next, the outer surface 53 of the sleeve 51 is machined to the final diameter D which diameter is only slightly larger than the depth of the port portions 54A and 55A and the portion of the plating layer extending along the shoulders 54C and 55C. As a result, when the liner thus formed, indicated totally by the reference numeral 58, is inserted into the cylinder block, which may have the construction as shown in the prior art of FIG. 4 and hence is identified by the same reference numerals, it will be seen that a smooth flow pattern is formed and also that no edges of the plating will be exposed that can be eroded or wore away by the flow. Hence, the disadvantages of the prior art constructions are readily overcome with the method and construction as described herein.

It is to be understood, however, that the foregoing description is only that of a preferred embodiment of the invention and that various changes and modifications may be made without departing from the spirit and scope of the invention, as defined by the appended claims.

I claim:

1. A cylinder liner for a reciprocating machine having a sleeve formed from a first material and having an inner cylindrical surface adapted to receive a piston, a port opening through said sleeve and having a first portion extending outwardly from said inner surface and a second portion of a larger cross-sectional area forming a shoulder at the juncture of said portions and extending outwardly to the outer periphery of said sleeve, and a plating layer extending along said inner surface and said first portion of said port opening and terminating inwardly of the outer diameter of the sleeve.

2. A cylinder liner for a reciprocating machine as set forth in claim 1, wherein the plating layer further extends at least in part along the shoulder so as to form an interlocking relationship with the sleeve.

3. A cylinder liner for a reciprocating machine as set forth in claim 1, wherein the cylinder liner is adapted to be machined to a final outer diameter such that the thickness of the sleeve is only slightly greater than the depth of the first portion whereby such machining does not upset the plating layer.

4. A method for forming a cylinder liner for a reciprocating machine comprising the steps of forming a sleeve from a first material and having an inner cylindrical surface adapted to receive a piston and a port opening through the sleeve and having a first portion extending outwardly from the inner surface and a second portion of larger cross sectional area forming a shoulder at the juncture of the portions and extending outwardly to the outer periphery of the sleeve and plating the inner cylindrical surface and first portion of the sleeve.

5. A method for forming a cylinder liner as set forth in claim 4 further including the step of providing a resist or stop coating on the second portion of the port opening so as to preclude the formation of a plating layer thereon.

6. A method for forming a cylinder line as set forth in claim 5, further including the step of machining the outer diameter of the sleeve so as to remove substantially all of the second portion after the plating has been deposited.

* * * * *